US009866932B2

(12) United States Patent
Chang et al.

(10) Patent No.: US 9,866,932 B2
(45) Date of Patent: Jan. 9, 2018

(54) ELECTRONIC HELMET AND METHOD THEREOF FOR CANCELLING NOISES

(71) Applicant: Chung Yuan Christian University, Taoyuan (TW)

(72) Inventors: Cheng-Yuan Chang, Taoyuan (TW); Sen-Maw Kuo, Wildwood, MO (US)

(73) Assignee: Chung Yuan Christian University, Taoyuan (TW)

( * ) Notice: Subject to any disclaimer, the term of this patent is extended or adjusted under 35 U.S.C. 154(b) by 0 days.

(21) Appl. No.: 15/015,829

(22) Filed: Feb. 4, 2016

(65) Prior Publication Data

US 2017/0142507 A1 May 18, 2017

(30) Foreign Application Priority Data

Nov. 17, 2015 (TW) ..... 104137824 A

(51) Int. Cl.

| | |
|---|---|
| ***H04R 1/02*** | (2006.01) |
| ***G10K 11/178*** | (2006.01) |
| ***A42B 3/30*** | (2006.01) |
| ***A42B 3/16*** | (2006.01) |
| ***H04R 1/00*** | (2006.01) |

(52) U.S. Cl.

CPC ..... *H04R 1/02* (2013.01); *A42B 3/166* (2013.01); *A42B 3/303* (2013.01); *G10K 11/1786* (2013.01); *G10K 11/1788* (2013.01); *H04R 1/00* (2013.01); *G10K 2210/128* (2013.01); *G10K 2210/3016* (2013.01); *G10K 2210/3027* (2013.01); *G10K 2210/3219* (2013.01); *G10K 2210/3221* (2013.01); *H04R 2420/07* (2013.01)

(58) Field of Classification Search

CPC ..... H04R 1/46; H04R 5/0335; H04N 7/81; G01C 21/00; G01S 19/13; H02J 1/00; G08B 3/00

USPC ..... 381/71.1; 455/569.1

See application file for complete search history.

(56) References Cited

U.S. PATENT DOCUMENTS

| | | | | |
|---|---|---|---|---|
| 2005/0117754 | A1 | 6/2005 | Sakawaki | |
| 2008/0008341 | A1* | 1/2008 | Edwards | H04R 25/552 381/315 |
| 2008/0220718 | A1* | 9/2008 | Sakamoto | H04B 1/385 455/41.2 |

(Continued)

*Primary Examiner* — Mohammad Islam

(74) *Attorney, Agent, or Firm* — Muncy, Geissler, Olds & Lowe, P.C.

(57) ABSTRACT

The present invention provides an electronic helmet for cancelling noises, which comprises a helmet including a plurality of microphones, a plurality of speakers and a first communication unit; and a mobile device including a second communication unit and a control unit. When the first communication unit in the helmet connects to the second communication unit in the mobile device, the control unit generates a plurality of control signals according to at least one sound or noise detected by the plurality of microphones. The mobile device uses the plurality of control signals to control the plurality of speakers outputting the at least one sound or anti-noise cancelling the noise. By the above electronic helmet, the present invention also provides a method integrating active noise control, hands-free communication, music listening, and voice navigation so as to achieve the proposes of cancelling the noises and improving the riding quality.

11 Claims, 6 Drawing Sheets

(56) References Cited

U.S. PATENT DOCUMENTS

| | | | | |
|---|---|---|---|---|
| 2008/0280653 | A1* | 11/2008 | Ma | H04M 9/082 455/569.1 |
| 2010/0095439 | A1* | 4/2010 | Nolan | A42B 3/286 2/421 |
| 2011/0130176 | A1* | 6/2011 | Magrath | G10K 11/178 455/570 |
| 2011/0183629 | A1* | 7/2011 | Walley | H04M 1/6066 455/68 |
| 2013/0070935 | A1* | 3/2013 | Hui | G10K 11/16 381/71.1 |
| 2013/0259250 | A1* | 10/2013 | Nicholson | G10K 11/1782 381/71.6 |
| 2014/0140552 | A1* | 5/2014 | Hui | G08B 3/00 381/309 |
| 2015/0130945 | A1* | 5/2015 | Yu | H04N 7/181 348/158 |

* cited by examiner

ELECTRONIC HELMET AND METHOD THEREOF FOR CANCELLING NOISES

FIELD OF THE INVENTION

The present invention relates to an electronic helmet, particularly relates to an electronic helmet and a method for noise cancellation.

BACKGROUND OF THE INVENTION

Convenience of daily life is improved along with science and technology progress. However, environment noise from transportation and industry causes damages on the sense of hearing. Presently, methods for noise cancellation are classified into passive noise control (PNC) and active noise control (ANC). Passive noise control is sound reduction by noise-isolating material such as sound-absorbing cotton. However, passive noise control neither truly eliminates noise nor totally overcomes low-frequency noise even using thick and weighty sound-absorbing cotton. Therefore, passive noise control neither resolves environment noise issue nor is convenient to be portable. Active noise control is a method for reducing unwanted sound by the addition of anti-noise. The anti-noise, whose phase is opposite to noise but amplitude is same as the ones of noise, is generated by a speaker according to a result of environment noise detection by a microphone. The environment noise cancellation can be achieved with the anti-noise to destroy strength of noise by forming destructive interference.

Presently, a helmet with active noise control combines an active noise control system into the helmet, which may provide a rider's head protection and environment noise cancellation. However, high cost results in little utilization frequency for such the helmet, except in aircraft industry, people working at aircraft stations protect themselves with such the helmets against noises from engines of aircraft.

US patent application of publication No. 20050117754 discloses a helmet of active noise cancellation, a vehicle system thereof and a method therefor. A rider may use an adaptive active noise control to cancel noise from wind, other vehicles and environment for improvement of riding quality. However, this helmet does not have noise cancellation combined with music preservation function and the peripheral circuit cost therefor is still too expensive.

Accordingly, the present invention provides an electronic helmet, and especially, an electronic helmet and cancellation method to integrate active noise control, hands-free communication, music listening, and voice navigation for noise cancellation.

SUMMARY OF THE INVENTION

One of objectives of the present invention provides an electronic helmet by using a mobile device as a platform of signal calculation/processing to replace a digital signal processor in a traditional active noise control. The mobile device may execute active noise control and generate control signals for controlling a speaker to output anti-noise that can cancel out the noise detected by a microphone. The noise cancellation, reduction of product cost and weight, readily portable convenience, and improvement of riding quality can be achieved.

Generally, it is necessary for a rider to wear a helmet when hitting a road. Wearing an earphone makes the helmet feel inconvenient, and making music out makes others feel bad. Accordingly, one of objectives of the present invention provides an electronic helmet of music-listening function that integrates a mobile device to execute a dual-channel and audio-integrating active noise control program and utilize a speaker to output sound of music and anti-noise. Thus, such an electronic helmet can cancel environment noise and preserve sound of music.

One of objectives of the present invention provides an electronic helmet of hands-free communication function for the rider's and others' safeties when the rider would like to answer a call in riding. A mobile device executes an adaptive acoustic echo cancellation program and outputs the answer's voice and anti-noise with a speaker to cancel echo interference in communication and ensure answering important calls for the rider in using hands-free communication.

One of objectives of the present invention provides an electronic helmet of voice navigation function. Wireless positioning provides the rider a route and a direction in a voice way and ensures the rider safety when he or she checks transportation signs.

Accordingly, an electronic helmet of noise cancellation includes: an electronic helmet having a plurality of microphones, a plurality of speakers, and a first communication unit, wherein the microphones are respectively electrically coupled to the first communication unit and configured to at least detect an sound or a noise, and the speakers are respectively electrically coupled to the first communication unit and configured to at least output the sound or an anti-noise; and a mobile device having a second communication unit and a control unit, wherein the control unit is electrically coupled to the second communication unit; and wherein after the first communication unit of the electronic helmet are linked with the second communication unit of the mobile device, the control unit of the mobile device generates a plurality of control signals in the light of the sound or the noise detected by the microphones of the electronic helmet, and the speakers of the electronic helmet are controlled by the mobile device with the control signals to output the sound or the anti-noise that cancels out the noise. Thus, noise cancellation and riding quality improvement are achieved.

Accordingly, a method for noise cancellation includes: starting an electronic helmet and a control unit in a mobile device; coupling a first communication unit in the electronic helmet with a second communication unit in the mobile device; at least detecting an sound or a noise by a plurality of microphones in the electronic helmet; generating a plurality of control signals by the control unit in the mobile device in the light of the sound or the noise detected by the microphones of the electronic helmet; and at least outputting the sound or an anti-noise by a plurality of speakers that are controlled by the mobile device with the control signals.

DETAILED DESCRIPTION OF THE PREFERRED EMBODIMENT

The above objects, technical features and advantages of the present invention will become more readily apparent to those ordinarily skilled in the art after reviewing the following detailed description and accompanying drawings. The presently described embodiments will be understood by reference to the drawings, but the sizes or ratios of components shown in drawings are not intended to limit the scope of the disclosure.

Figure 1:
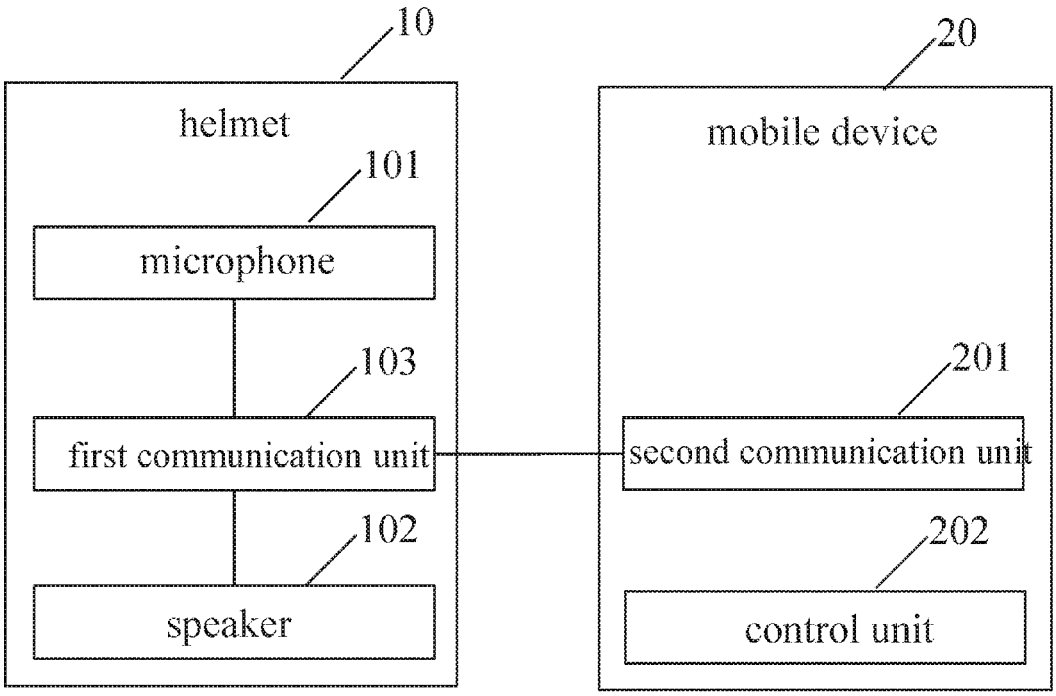
FIG. 1 is a schematic system block diagram illustrating an electronic helmet for noise cancellation according to the present invention.

FIG. 1 is a schematic system block diagram illustrating an electronic helmet for noise cancellation according to the present invention. Shown in FIG. 1, an electronic helmet for noise cancellation includes an electronic helmet 10 having some microphones 101, some speakers 102, and a first communication unit 103, and a mobile device 20 having a second communication unit 201, and a control unit 202. These microphones 101 are electrically coupled to the first communication unit 103 and configured to detect sound to be wanted (such as music) and noise not to be wanted (such as noise from vehicles). The speakers 102 are electrically coupled to the first communication unit 103 and configured to output sound or anti-noise. The control unit 202 is electrically coupled to the second communication unit 201. After the second communication unit 201 of the mobile device 20 is coupled to the first communication unit 103 of the electronic helmet 10, the control unit 202 generates multitudes of control signals in the light of at least the sound or noise detected by the microphones 101. The speakers 102 are controlled by the control signals of the mobile device 20 to at least output the sound or the anti-noise for noise cancellation. Thus, noise can be cancelled and riding quality can be improved.

In a preferred embodiment of electronic helmet, the electronic helmet 10 further includes a power supply device of battery power to provide power to the microphones 101, the speakers 102, and the first communication unit 103.

In a preferred embodiment of electronic helmet, the mobile device 20 may be a smart phone, a tablet computer or a mobile telecommunication, but not limited to.

In a preferred embodiment of electronic helmet, the first communication unit 103 and the second communication unit 201 may be one of a wired telecommunication module and a wireless telecommunication module.

In a preferred embodiment of electronic helmet, the wireless telecommunication module may be a blue tooth module.

Figure 2:
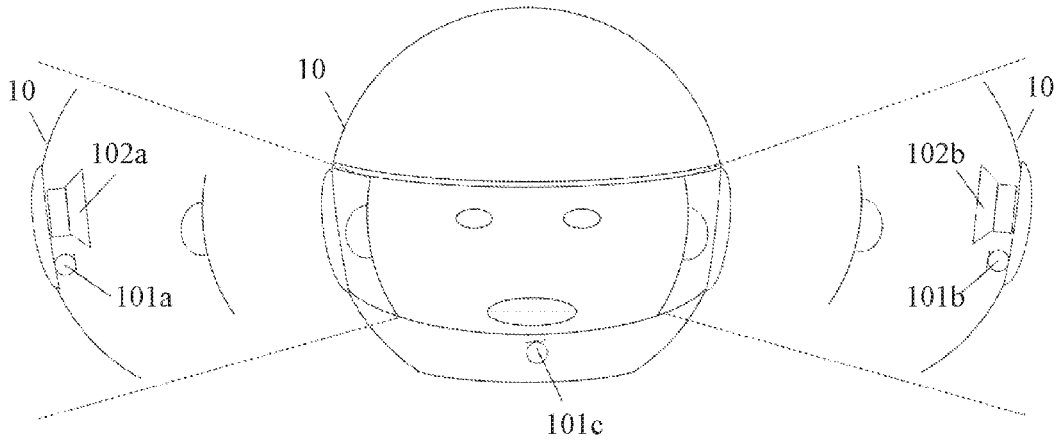
FIG. 2 is a schematic diagram illustrating the structure of an electronic helmet according to the present invention.

FIG. 2 is a schematic diagram illustrating the structure of an electronic helmet according to the present invention. Shown in FIG. 2, the electronic helmet 10 includes three microphones 101*a*, 101*b* and 101*c*, and two speakers 102*a* and 102*b*. The speakers 102*a* and 102*b* are electrically coupled to the first communication unit 103 (not shown in FIG. 2) and respectively deposited at two sides of the electronic helmet 10 to close to the position corresponding to user's ears, and configured to output the sound or the anti-noise. The three microphones 101*a*, 101*b* and 101*c* are electrically coupled to the first communication unit 103. The three microphones 101*a*, 101*b*, and 101*c* are deposited within the electronic helmet 10. Both of the microphones 101*a* and 101*b* are deposited at the right and left inner sides of the electronic helmet 10 and below the two speakers 102*a* and 102*b*, the microphone 101*c* is deposited around user's mouse position. The three microphones 101*a*, 101*b*, and 101*c* are configured to at least detect the sound or the noise. When the user wears the electronic helmet 10 on the user's head, the electronic helmet 10 may create two quiet zones at the sides of the user's ears to cancel noise. It is noted that the numbers and arrangement of the microphones 101*a*, 101*b* and 101*c* and the speakers 102*a* and 102*b* in the electronic helmet 10 are only one embodiment for function and effect illustration of the electronic helmet 10, not to be limited in the present invention or limit the scope of the present invention.

In electronic helmet of the present invention, the mobile device 20 further includes an active noise control program, a dual-channel audio-integrating active noise control program, and an adaptive acoustic echo cancellation program. A mobile phone application program is preferred ones for these programs aforementioned. Once user starts the mobile phone application program of the mobile device 20, the second communication unit 201 in the mobile device 20 and the first communication unit 103 in the electronic helmet 10 are linked with each other, and the control unit 202 in the mobile device 20 executes the functions of the mobile phone application program.

The operation of the programs will be described as follows.

Figure 3:
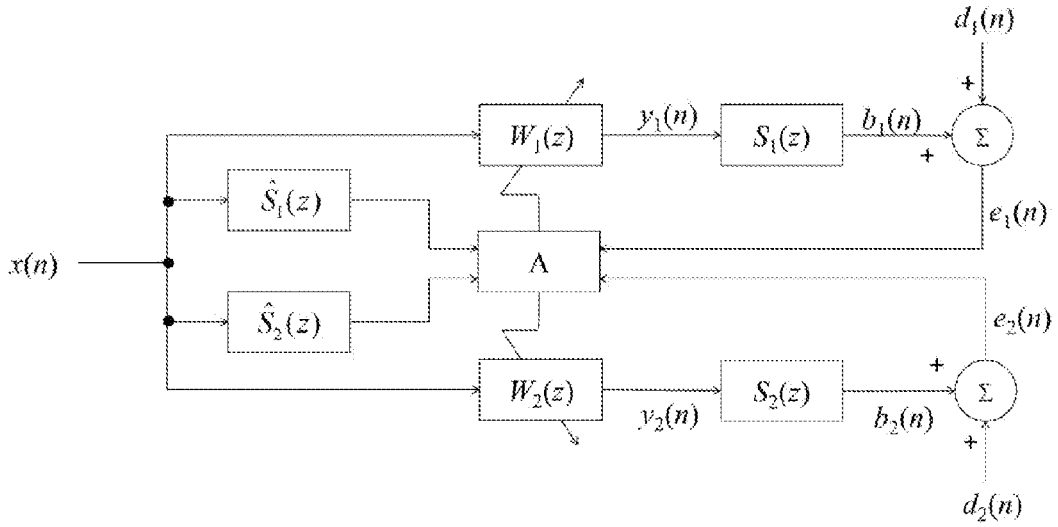
FIG. 3 is a schematic flow diagram illustrating one embodiment of active noise control according to the present invention.

FIG. 3 is a schematic flow diagram illustrating one embodiment signal of active noise control program according to the present invention. Please refer to FIG. 2 to FIG. 3, the active noise control program utilizes the three microphones 101*a*, 101*b* and 101*c* and the two speakers 102*a* and 102*b* deposited in the electronic helmet 10 as a signal input or output device. It is noted that $S_1(z)$ in FIG. 3 is a secondary path frequency response from the speaker 102*a* to the microphone 101*a*, $S_2(z)$ is the one from the speaker 102*b* to the microphone 101*b*. Two estimated secondary path frequency responses $\hat{S}_1(z)$, and $\hat{S}_2(z)$, which are respectively corresponding to the secondary path frequency responses $S_1(z)$ and $S_2(z)$, are determined by selecting some suitable testing signals (such as white noises) to be outputted by the speakers 102*a* and 102*b* and detected by the microphones 101*a* and 101*b*. Once the first communication unit 103 in the electronic helmet 10 and the second communication unit 201 in the mobile device 20 are linked, the electronic helmet 10 and the mobile device 20 start off receiving and transmitting signal. The three microphones 101*a*, 101*b* and 101*c* respectively detect the noises $d_1(n)$, $d_2(n)$ and $x(n)$. Next, the control unit 202 of the mobile device 20 starts off executing the active noise control program after receiving the noises $d_1(n)$, $d_2(n)$ and $x(n)$. Two adaptive wave filters $W_1(z)$ and $W_2(z)$ in program forms respectively generate two control signals $y_1(n)$ and $y_2(n)$ after receiving the noise $x(n)$. Next, after the two control signals $y_1(n)$ and $y_2(n)$ are processed with the secondary path frequency responses $S_1(z)$ and $S_2(z)$ and outputted by the speakers 102*a* and 102*b*, two anti-noises $b_1(n)$ and $b_2(n)$ are respectively generated and received by the microphones 101*a* and 101*b*. Signal $e_1(n)$ may be generated by processing the anti-noises $b_1(n)$ and the noise $d_1(n)$ that is detected by the microphone 101*a* at same time. Meanwhile, signal $e_2(n)$ is generated by processing the anti-noises $b_2(n)$ and the noise $d_2(n)$ that is detected by the microphone 101*b*. Next, both the two signals $e_1(n)$ and $e_2(n)$ together with the next noise $x(n)$ may be inputted into a filtering algorithm A after they are processed with the secondary path frequency responses $\hat{S}_1(z)$ and $\hat{S}_2(z)$. The filtering algorithm A can adjust the two adaptive wave filters $W_1(z)$ and $W_2(z)$. The aforementioned process can be executed again after the next noises $d_1(n)$ and $d_2(n)$ are respectively detected by the two adjusted adaptive wave filters $W_1(z)$ and $W_2(z)$ together with the two microphones 101*a* and 101*b*. In the embodiment, the filtering algorithm A may be Filtered-X Least Mean Square algorithm, but not limited to. The active noise control program of the embodiment is implemented by the control unit 202 of the mobile device 20 and generates the control signals $y_1(n)$ and $y_2(n)$ in the light of the noises $d_1(n)$, $d_2(n)$ and $x(n)$ detected by the microphones 101*a*, 101*b* and 101*c* of the electronic helmet 10. The two speakers 102*a* and 102*b* in the electronic helmet 10 output the anti-noises $b_1(n)$ and $b_2(n)$ to cancel noises $d_1(n)$, $d_2(n)$ and $x(n)$.

Figure 4:
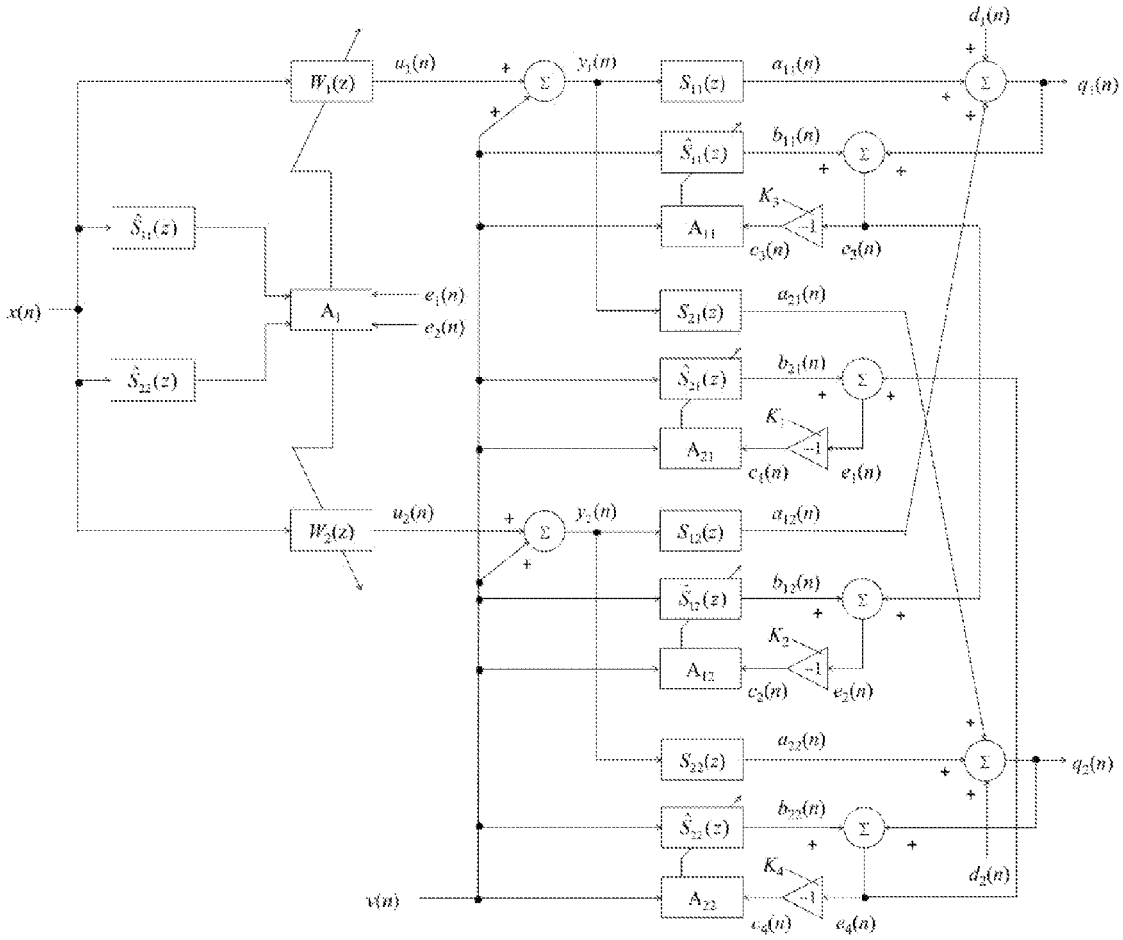
FIG. 4 is a schematic flow diagram illustrating another embodiment of dual-channel active noise control program integrated with sound according to the present invention.

FIG. 4 is a schematic flow diagram illustrating another embodiment of dual-channel and audio-integrating active noise control program according to the present invention. Please refer to FIG. 2 and FIG. 4, the embodiment of dual-channel and audio-integrating active noise control program utilizes the three microphones 101*a*, 101*b* and 101*c* in the electronic helmet 10 and the two speakers 102*a* and 102*b* as signal input or output devices. It is noted that $S_{11}(z)$ in FIG. 4 is a secondary path frequency response from the speaker 102*a* to the microphone 101*a*, $S_{21}(z)$ is the one from the speaker 102*b* to the microphone 101*a*, $S_{12}(z)$ is the one from the speaker 102*a* to the microphone 101*b*, and $S_{22}(z)$ is the one from the speaker 102*b* to the microphones 101*b*. Four estimated secondary path frequency responses $\hat{S}_{11}(z)$, $\hat{S}_{12}(z)$, $\hat{S}_{21}(z)$ and $\hat{S}_{22}(z)$ are determined by selecting a little suitable testing signals (such as white noise) to be outputted by the two speakers 102*a* and 102*b* and detected by the microphones 101*a* and 101*b*. Once the first communication unit 103 in the electronic helmet 10 and the second communication unit 201 in the mobile device 20 are linked with each other, the electronic helmet 10 and the mobile device 20 start off receiving and transmitting signal. The dual-channel and audio-integrating active noise control program can start off executing after the three microphones 101*a*, 101*b* and 101*c* respectively detect the noises $d_1(n)$, $d_2(n)$ and $x(n)$. The noise $x(n)$ together with the signals $e_1(n)$ and $e_2(n)$ will be respectively inputted into the filtering algorithm A, after the noise $x(n)$ is processed with the secondary path frequency responses $\hat{S}_{11}(z)$ and $\hat{S}_{22}(z)$. The filtering algorithm A1 can adjust the two wave filters $W_1(z)$ and $W_2(z)$ in the program forms. Two adaptive wave filters $W_1(z)$ and $W_2(z)$ in the program forms respectively generate two control signals $u_1(n)$ and $u_2(n)$ after receiving the noise $x(n)$. The control signals $y_1(n)$ and $y_2(n)$, which are generated by combining the signals $u_1(n)$ and $u_2(n)$ and sound of music, control the speakers 102*a* and 102*b* to output the anti-noises $a_{11}(n)$ and $a_{22}(n)$ that are received by the microphones 101*a* and 101*b*. Besides, the control signals $y_1(n)$ outputted by the speaker 102*a* may be transmitted to the microphone 101*b* (this frequency response shown as $S_{21}(z)$) to generate sound $a_{21}(n)$. The control signals $y_2(n)$ outputted by the speaker 102*b* may be transmitted to the microphone 101*a* (this frequency response shown as $S_{12}(z)$) to generate sound $a_{12}(n)$. Thus, signal $q_1(n)$ received by the microphone 101*a* includes the anti-noise $a_{11}(n)$, the sound $a_{12}(n)$ and the noise $d_1(n)$. In the meantime, signal $q_2(n)$ received by the microphone 101*b* includes the anti-noise $a_{22}(n)$, the sound $a_{21}(n)$ and the noise $d_2(n)$. After receiving the sound of music $v(n)$, the estimated secondary path frequency responses $\hat{S}_{11}(z)$, $\hat{S}_{12}(z)$, $\hat{S}_{21}(z)$ and $\hat{S}_{22}(z)$ respectively output signals $b_{11}(n)$, $b_{12}(n)$, $b_{21}(n)$ and $b_{22}(n)$. Signal $e_3(n)$ will be generated by processing the signals $q_1(n)$ and $b_{11}(n)$. Similarly, signal $e_4(n)$ will be generated by processing the signals $q_2(n)$ and $b_{22}(n)$; signal $e_2(n)$ will be generated by processing the signals $e_3(n)$ and $b_{12}(n)$; and signal $e_1(n)$ will be generated by processing the signals $e_4(n)$ and $b_{21}(n)$. Next, the signals $e_1(n)$, $e_2(n)$, $e_3(n)$ and $e_4(n)$ are respectively inputted into inverter ($K_1$, $K_2$, $K_3$ and $K_4$), and then the inverter ($K_1$, $K_2$, $K_3$ and $K_4$) respectively output signals $c_1(n)$, $c_2(n)$, $c_3(n)$ and $c_4(n)$. Next, the signal $c_1(n)$ and the sound of music $v(n)$ may be inputted into the filtering algorithm $A_{21}$, the filtering algorithm $A_{21}$ will adjust the estimated frequency responses of secondary path $\hat{S}_{21}(n)$. In the meantime, the signal $c_2(n)$ and the sound of music $v(n)$ may be inputted into the filtering algorithm $A_{12}$, the filtering algorithm $A_{12}$ will adjust the estimated frequency responses of secondary path $\hat{S}_{12}(n)$; the signal $c_3(n)$ and the sound of music $v(n)$ may be inputted into the filtering algorithm $A_{11}$, the filtering algorithm $A_{11}$ will adjust the estimated frequency responses of secondary path $\hat{S}_{11}(n)$; and the signal $c_4(n)$ and the sound of music $v(n)$ may be inputted into the filtering algorithm $A_{22}$, the filtering algorithm $A_{22}$ will adjust the estimated frequency responses of secondary path $\hat{S}_{22}(n)$. The aforementioned process can be executed again after the next noises $d_1(n)$, $d_2(n)$ and $x(n)$ are respectively detected by the four adjusted adaptive wave filters $\hat{S}_{11}(n)$, $\hat{S}_{12}(n)$, $\hat{S}_{21}(n)$ and $\hat{S}_{22}(n)$ together with the three microphones 101*a*, 101*b* and 101*c*. In the embodiment, the filtering algorithm $A_1$ may be Filtered-X Least Mean Square algorithm, and the four filtering algorithms $A_{11}$, $A_{12}$, $A_{21}$ and $A_{22}$ may be Least Mean Square algorithm, but not limited to. The dual-channel and audio-integrating active noise control program of the embodiment is implemented by the control unit 202 in the mobile device 20 and generates the control signals $y_1(n)$, and $y_2(n)$ by combining the signals $u_1(n)$ and $u_2(n)$ with the sound of music $v(n)$, in the light of the sound of music $v(n)$ and the noises $d_1(n)$, $d_2(n)$ and $x(n)$ detected by the microphones 101*a*, 101*b* and 101*c* of the electronic helmet 10. The speakers 102*a* and 102*b* of the electronic helmet 10 are controlled by the mobile device 20 with the control signals $y_1(n)$ and $y_2(n)$, output the anti-noises $a_{11}(n)$ and $a_{22}(n)$ that may cancel the noises $d_1(n)$, $d_2(n)$ and $x(n)$, and retain the sound of music $v(n)$.

Figure 5:
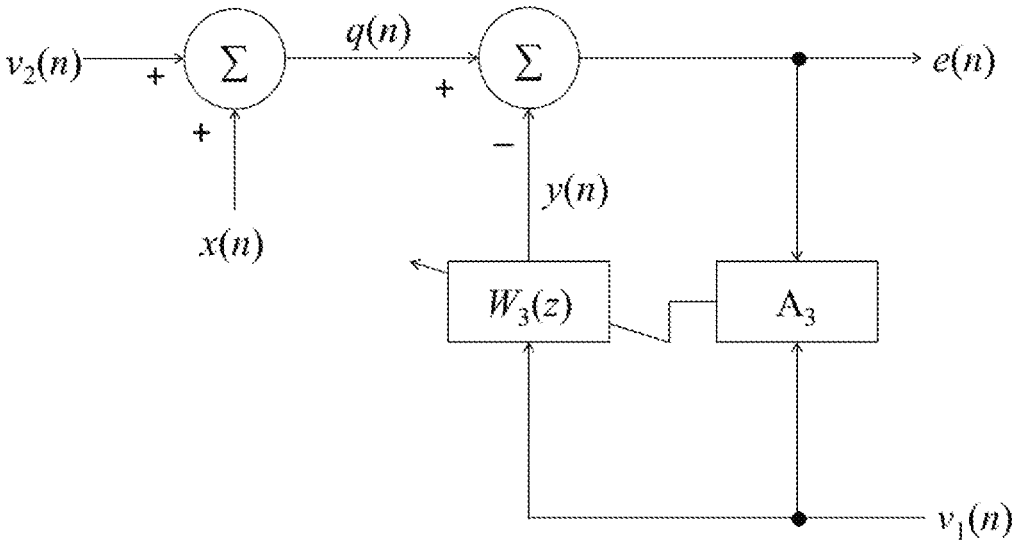
FIG. 5 is a schematic flow diagram illustrating one embodiment of adaptive acoustic echo cancellation program according to the present invention.

FIG. 5 is a schematic flow diagram illustrating one embodiment of adaptive acoustic echo cancellation program according to the present invention. Please refer to FIG. 2 and FIG. 5, one microphone 101*c* in the electronic helmet 10 near user's mouse and the speaker 102*a* in the electronic helmet 10 near user's ear are utilized as signal input or output devices for the adaptive acoustic echo cancellation program. The sound $v_1(n)$ of an answer is outputted by the speaker 102*a*, influenced by acoustic media and converted into the noise $x(n)$ in echo form. The sound $v_1(n)$ is combined with user's sound $v_2(n)$ to generate signal $q(n)$, and then the signal $q(n)$ is detected by the microphone 101*c* near the user's mouse. Moreover, the sound $v_1(n)$ is inputted into the adaptive filter $W_3(z)$ in program form, and then the adaptive filter $W_3(z)$ can generate signal $y(n)$. Next, the sound $e(n)$ without echo interference is generated after signals $q(n)$ and $y(n)$ are processed, and then transferred into the answer's ear. The sound $e(n)$ and the answer's sound $v_1(n)$ are inputted into a filtering algorithm $A_3$ for adjusting the adaptive filter $W_3(z)$. The aforementioned process can be executed again after the microphone 101*c* continuously detects user's next sound $v_2(n)$ and the noise $x(n)$ that results from echo. In the embodiment, the filtering algorithm A3 may be a Least Mean Square algorithm, but not limited to. The adaptive acoustic echo cancellation program of the embodiment is implemented by the control unit 202 in the mobile device 20 and generates the control signal $y(n)$ in the light of the sound $v_2(n)$ and the noise x(n) that are detected by the microphone 101*c* in the electronic helmet 10 and the voice signal $v_1(n)$ of a remote answer outputted by the speaker 102*a*. Then the sound e(n) without echo interference can be generated and transmitted to the remote answer through the mobile device 20.

Accordingly, the electronic helmet of the present invention includes the control unit 202 to have functions as follows: (1) the active noise control program used to cancel snore and noise; (2) the dual-channel and audio-integrating active noise control program used to cancel snore and noise but retain sound such as music; and (3) adaptive acoustic echo cancellation program used to cancel echo resulted from telecommunication.

Next, the electronic helmet of the present invention includes the control unit 202 to have voice navigation function. User speaks out a destination with his or her sound that is detected by the microphone 101*c* near the user's mouse. The control unit 202 of the mobile device 20 fixes the user's location and make a route plan to be outputted by the speakers 102*a* and 102*b* near the user's ears.

The method for noise cancellation is illustrated as follows.

Figure 6:
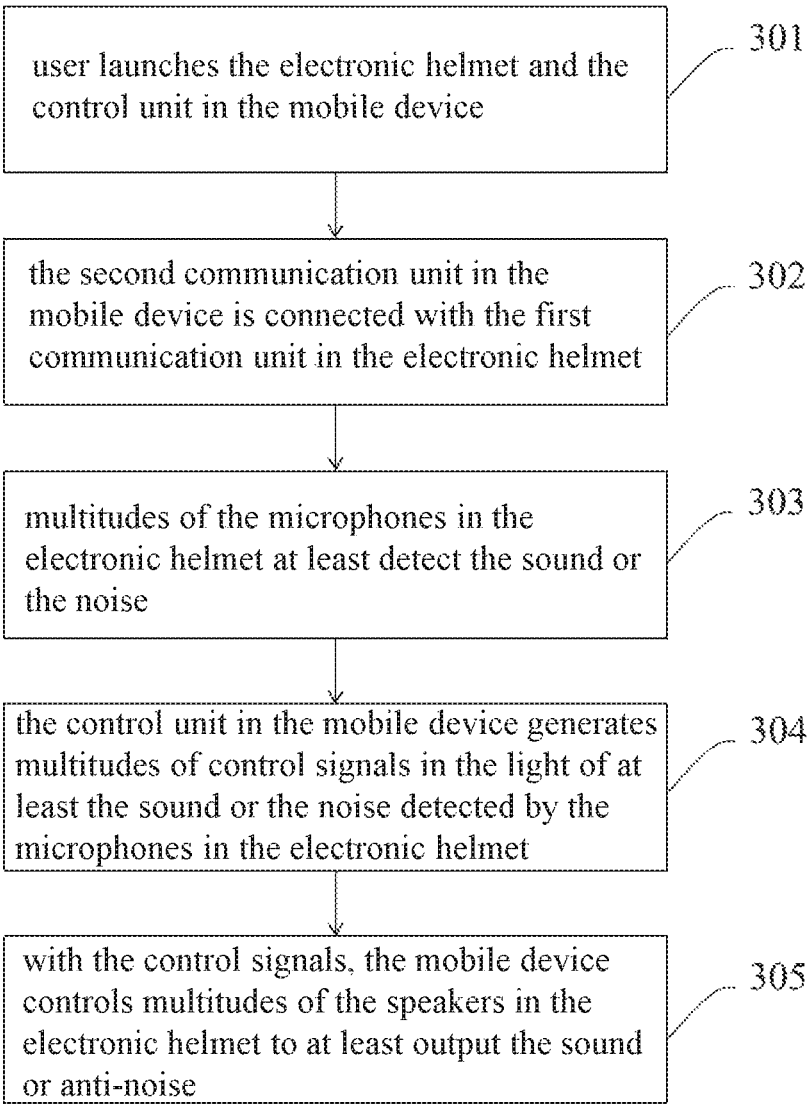
FIG. 6 is a schematic flow diagram illustrating a method for noise cancellation according to the present invention.

FIG. 6 is a schematic flow diagram illustrating a method of snore and noise cancellation according to the present invention. Shown in FIG. 6, step 301: user launches the electronic helmet 10 and the control unit 202 in the mobile device 20, and the second communication unit 201 in the mobile device 20 may be automatically launched by the control unit 202; step 302: the second communication unit 201 in the mobile device 20 is connected with the first communication unit 103 in the electronic helmet 10; step 303: multitudes of the microphones 101 in the electronic helmet 10 at least detect the sound or the noise; step 304: the control unit 202 in the mobile device 20 generates multitudes of control signals in the light of at least the sound or the noise detected by the microphones 101 in the electronic helmet 10; and step 305: with the control signals, the mobile device 20 controls multitudes of the speakers 102 in the electronic helmet 10 to at least output the sound or anti-noise.

Accordingly, an electronic helmet of snore and noise cancellation is provided, which includes: the electronic helmet 10 having multitudes of the microphones 101, multitudes of the speakers 102 and the first communication unit 103; and the mobile device 20 having the second communication unit 201 and the control unit 202. If the first communication unit 103 of the electronic helmet 10 and the second communication unit 201 of the mobile device 20 are connected, the control unit 202 generates multitudes of control signals in the light of the sound or noise detected by the microphones 101, and the mobile device 20 controls the speakers 102 with the control signal to output the sound or/and anti-noise that may cancel out the noise. With the electronic helmet, a method of integrating active noise control, hand-free communication, music listening, and voice navigation is also provided for the purposes for noise cancellation and improvement on riding quality.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An electronic helmet for noise cancellation, comprising:

an electronic helmet having a plurality of microphones, a plurality of speakers, and a first communication unit, wherein the microphones are respectively electrically coupled to the first communication unit and configured to at least detect a sound or a noise, and the speakers are respectively electrically coupled to the first communication unit and configured to at least output the sound or an anti-noise; and a mobile device having a second communication unit and a control unit, wherein the control unit is electrically coupled to the second communication unit;

wherein after the first communication unit of the electronic helmet is connected with the second communication unit of the mobile device, the control unit of the mobile device generates a plurality of control signals responsive to the sound or the noise detected by the microphones of the electronic helmet, wherein the control unit executes an active noise control program based on the sound or the noise and the active noise control program generates the control signals responsive to the noise and the speakers of the electronic helmet are controlled by the mobile device with the control signals to output the sound or the anti-noise that cancels out the noise.

2. The electronic helmet for noise cancellation of claim 1, wherein the mobile device is a smart phone or a tablet computer.

3. The electronic helmet for noise cancellation of claim 1, wherein the first communication unit and the second communication unit are one of a wired communication module and a wireless communication module.

4. The electronic helmet for noise cancellation of claim 3, wherein the wireless communication module is a Bluetooth module.

5. The electronic helmet for noise cancellation of claim 1, wherein the control unit executes a dual-channel and audio-integrating active noise control program, the dual-channel and audio-integrating active noise control program generates the control signals response to the sound and the noise detected by the microphones in the electronic helmet, and the speakers of the electronic helmet are controlled by the mobile device with the control signals to output the anti-noise for noise cancellation and retain the sound.

6. The electronic helmet for noise cancellation of claim 1, wherein the control unit executes an adaptive acoustic echo cancellation program, the adaptive acoustic echo cancellation program generates the control signals responsive to the sound and the noise resulted from echo that both are detected by the microphones and the sound from a remote answer outputted by the speakers, and the sound without echo interference is transmitted to the remote answer through the mobile device.

7. A method for noise cancellation, comprising:

starting an electronic helmet and a control unit in a mobile device;

coupling a first communication unit in the electronic helmet with a second communication unit in the mobile device;

at least detecting a sound or a noise by a plurality of microphones in the electronic helmet;

executing an active noise control program according to the sound or the noise detected by the microphones in the electronic helmet;

generating a plurality of control signals by the control unit in the mobile device according to the active noise control program; and at least outputting the sound or an anti-noise by a plurality of speakers in the electronic helmet that are controlled by the mobile device with the control signals.

8. The method for noise cancellation of claim 7, wherein the first communication unit and the second communication unit are one of a wired communication module and a wireless communication module.

9. The method for noise cancellation of claim 8, wherein the wireless communication module is a Bluetooth module.

10. The method for noise cancellation of claim 7, wherein the mobile device is a smart phone or a tablet computer.

11. The electronic helmet for noise cancellation of claim 1, wherein the active noise control program comprises Filtered-X Least Mean Square algorithm.

* * * * *